US005357080A

United States Patent [19]

Vetter et al.

[11] Patent Number: 5,357,080

[45] Date of Patent: Oct. 18, 1994

[54] COOKTOP WITH CONTROL SURFACE ON FRAME LEG

[75] Inventors: Roland Vetter, Giengen-Sachsenhausen; Georg Brandl, Palling; Jörg Ramonat, Traunstein; Günter Varnhorn, Giengen, all of Fed. Rep. of Germany

[73] Assignee: Bosch-Siemens Hausgeräte GmbH, Munich, Fed. Rep. of Germany

[21] Appl. No.: 64,847

[22] Filed: May 20, 1993

[30] Foreign Application Priority Data

May 20, 1992 [DE] Fed. Rep. of Germany ..... 4216678

[51] Int. Cl.[5] ..... F24C 7/08; F24C 15/00

[52] U.S. Cl. ..... 219/453; 219/464; 126/214 R; 116/318; 116/305; 116/279

[58] Field of Search ..... 219/443–468; 126/214 A, 214 R, 214 D; 116/315, 316, 318, 279, 298, 305

[56] References Cited

U.S. PATENT DOCUMENTS 3,944,786 3/1976 Detterbeck ..... 219/453

FOREIGN PATENT DOCUMENTS

| | | | |
|---|---|---|---|
| 254347 | 9/1966 | Austria | 219/445 |
| 8814158 | 2/1989 | Fed. Rep. of Germany . | |
| 2462663 | 3/1981 | France . | |
| 402210 | 5/1966 | Switzerland | 219/446 |
| 1568705 | 6/1980 | United Kingdom | 219/446 |
| 2100853 | 1/1983 | United Kingdom | 219/458 |
| 2125537 | 3/1984 | United Kingdom | 219/464 |
| 2212260 | 7/1989 | United Kingdom . | |

*Primary Examiner*—Bruce A. Reynolds
*Assistant Examiner*—John A. Jeffery
*Attorney, Agent, or Firm*—Herbert L. Lerner; Laurence A. Greenberg

[57] ABSTRACT

A cooktop includes a cooking surface preferably having a plurality of cooking locations. A cooktop frame to be inserted into a kitchen work counter surrounds the cooking surface and has a frame leg protruding above the cooking surface. The frame leg has an outer leg surface extending downward in the inserted position of the cooktop. Control devices for the cooking locations are disposed at least on the frame leg. The control devices include at least one operating device disposed on the outer leg surface of the frame leg.

13 Claims, 3 Drawing Sheets

COOKTOP WITH CONTROL SURFACE ON FRAME LEG

BACKGROUND OF THE INVENTION

1. Field of the Invention

The invention relates to a cooktop or rangetop, including a cooktop surface or cooking surface preferably having a plurality of cooking locations, the surface being surrounded by a cooktop frame that can be inserted into a kitchen work counter and that has control devices for the cooking locations, at least on one frame leg that protrudes above the cooking surface.

2. Description of the Related Art In household cooktops, it is known (from German Petty Patent DE-GM 88 14 158) for the back of a closed frame, which carries a glass ceramic plate that has cooking locations or burners and surrounds the glass ceramic plate, to be provided with a podium-like raised portion, with a control panel that slopes upward relative to the cooking surface, and with the control panel being a component of the frame and carrying indicators and operating elements for the cooking locations.

It is accordingly an object of the invention to provide a cooktop, which improves the hereinafore-mentioned disadvantages of the heretofore-known devices of this general type in terms of its handling and usage characteristics.

With the foregoing and other objects in view there is provided, in accordance with the invention, a cooktop, comprising a cooking surface preferably having a plurality of cooking locations; a cooktop frame to be inserted into a kitchen work counter, the cooktop frame surrounding the cooking surface and having a frame leg protruding above the cooking surface, the frame leg having an outer leg surface extending downward in the inserted position of the cooktop; and control devices for the cooking locations being disposed at least on the frame leg, the control devices including at least one operating device disposed on the outer leg surface of the frame leg.

SUMMARY OF THE INVENTION

In accordance with another feature of the invention, there is provided a control surface being directly or indirectly associated with the frame leg, bordering the downward extending outer leg surface and serving as part of the cooking surface, and indicator devices being associated with the at least one operating device and being disposed on the control surface.

In accordance with a further feature of the invention, the frame leg having the control devices or the control surface is raised in podium-like fashion relative to the cooking surface having the cooking locations.

In accordance with an added feature of the invention, the cooking surface is horizontal, and the control surface is immediately adjacent to and rises at an angle upward relative to the cooking surface.

In accordance with an additional feature of the invention, the cooking surface and the control surface are formed of a one-piece glass ceramic plate.

In accordance with yet another feature of the invention, the cooking surface and the control surface are formed of separate glass ceramic plates having edges being adjacent one another and joined together by connecting means, preferably in an articulated manner.

In accordance with yet a further feature of the invention, there are provided front and back panels, the frame leg with the control devices being a lateral frame leg disposed between the front and back panels.

In accordance with yet an added feature of the invention, there are provided indicator devices being disposed underneath the control surface, and transparent windows in the control surface for the indicator devices.

In accordance with yet an additional feature of the invention, the at least one operating device includes rotatable knurled disks having circular portions protruding slightly above the outer leg surface of the frame leg, and there are provided electrical or electronic switches or regulators being individually associated with heating bodies for the cooking locations and being connected to the knurled disks, and optionally associated indicator devices connected to the knurled disks.

In accordance with again another feature of the invention, the knurled disks have surfaces, and the indicator devices are adjustment identifiers on the surfaces indicating a rotary angle at the time.

In accordance with a concomitant feature of the invention, the at least one operating device on the outer leg surface of the frame leg is in the form of pushbuttons.

Since the control devices, such as the setting devices for supplying energy to the various cooking locations, are disposed in the particular way that is described according to the invention, an advantage is attained which is that the cooktop surface, or in other words the cooking surface itself and optionally an adjoining control surface with indicator devices, is not broken up by switches of any kind, such as rotary knobs or pushbuttons. As a result, cleaning of this uniform surface is improved substantially as compared with cooktops having switch devices disposed in the region of the cooking surface or in its immediate vicinity. Furthermore, this disposition provides a greater measure of operating safety, since the operating devices are located outside the cooktop surface, thereby averting unintentional actuation of the cooktop while cleaning its surface, for instance. An especially intuitive configuration of the control devices overall is attained if the control devices on the side are directly assigned a control surface inside the cooktop surface, which serves as a carrier for indicator devices assigned to the operating devices. Through the use of identifying symbols or numbers, these indicator devices indicate the heating output or temperature that has been set. Preferably, this control surface is disposed on a lateral surface of the cooktop between the front and back panel and is inclined in podium-like fashion toward the cooking surface.

Other features which are considered as characteristic for the invention are set forth in the appended claims.

Although the invention is illustrated and described herein as embodied in a cooktop, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
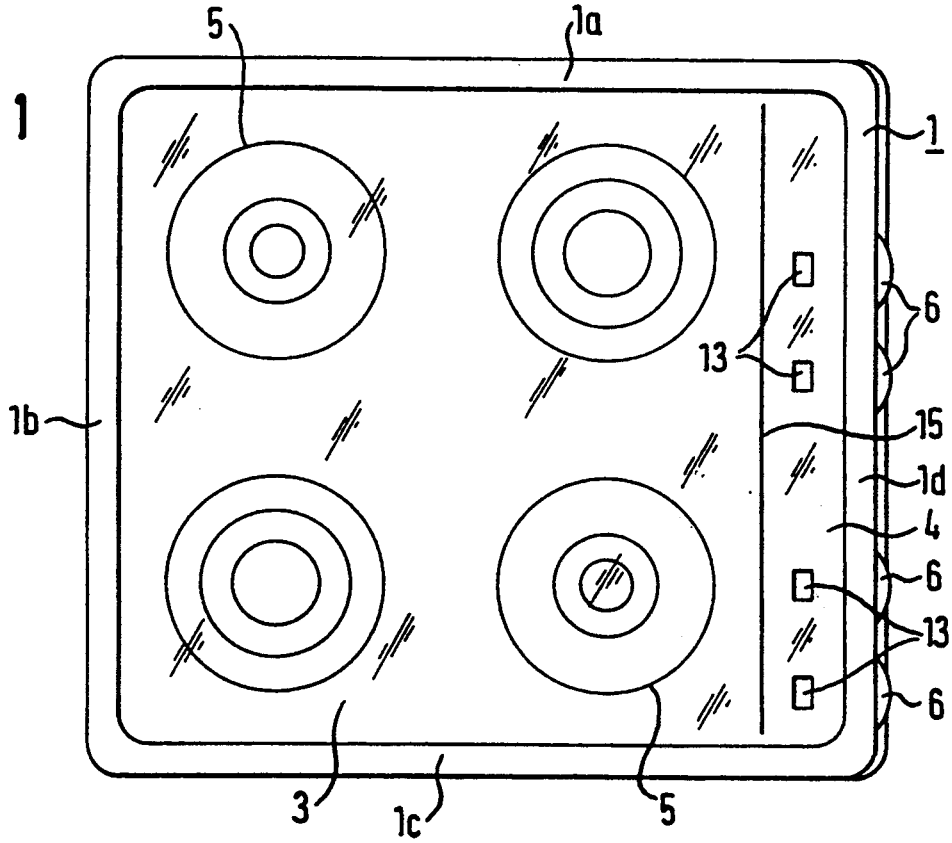
FIG. 1 is a diagrammatic, top-plan view of a cooktop.
Figure 2:
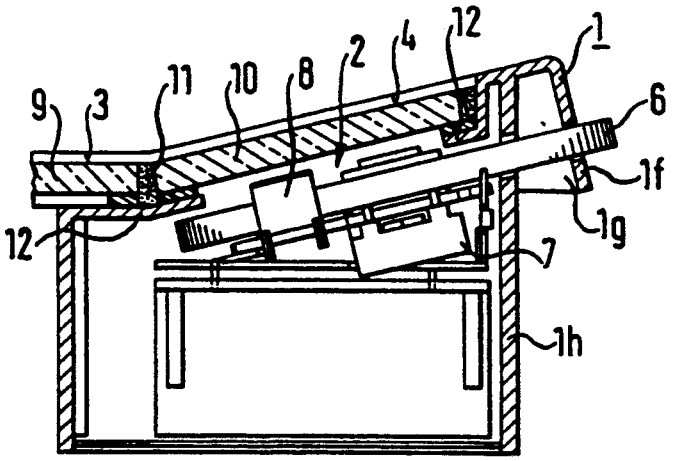
FIG. 2 is a fragmentary, longitudinal-sectional view of the cooktop.

Referring now to the figures of the drawing in detail and first, particularly, to FIGS. 1 and 2 thereof, there is seen a cooktop or rangetop which is formed of a cooktop frame 1 surrounding the entire cooktop and having frame legs 1*a*, 1*b*, 1*c* and 1*d* abutting one another at right angles and leg surfaces such as 1*f* and 1*g* protruding substantially vertically downward, and a substructure 1*h* which is not described in further detail but is used for receiving and retaining operating and indicator devices 2 and non-illustrated heating bodies in the region of cooking locations or burners 5. Disposed inside the frame legs 1*a*–1*d* are a cooktop surface or cooking surface 3 formed of glass ceramic material, and a control surface 4 disposed laterally beside the cooking surface 3, below which the aforementioned operating and indicator devices 2 are located. The aforementioned heating bodies are located underneath the cooking surface 3, specifically in the region of markings for the cooking locations 5. In the exemplary embodiment, a total of four cooking location markings 5 are provided. The operating devices in the exemplary embodiment include knurled disks 6, which protrude slightly outwardly to the side beyond the leg surface 1*f* with a circular disk segment, for adjusting the heating output for the cooking locations 5. These disks 6 may be connected to encoding switches 7 and corresponding further electric or electronic switch devices connected to the heating bodies. One indicator device 8, for example in the form of a seven-segment display, is likewise associated with each knurled disk 6.

Figure 3:
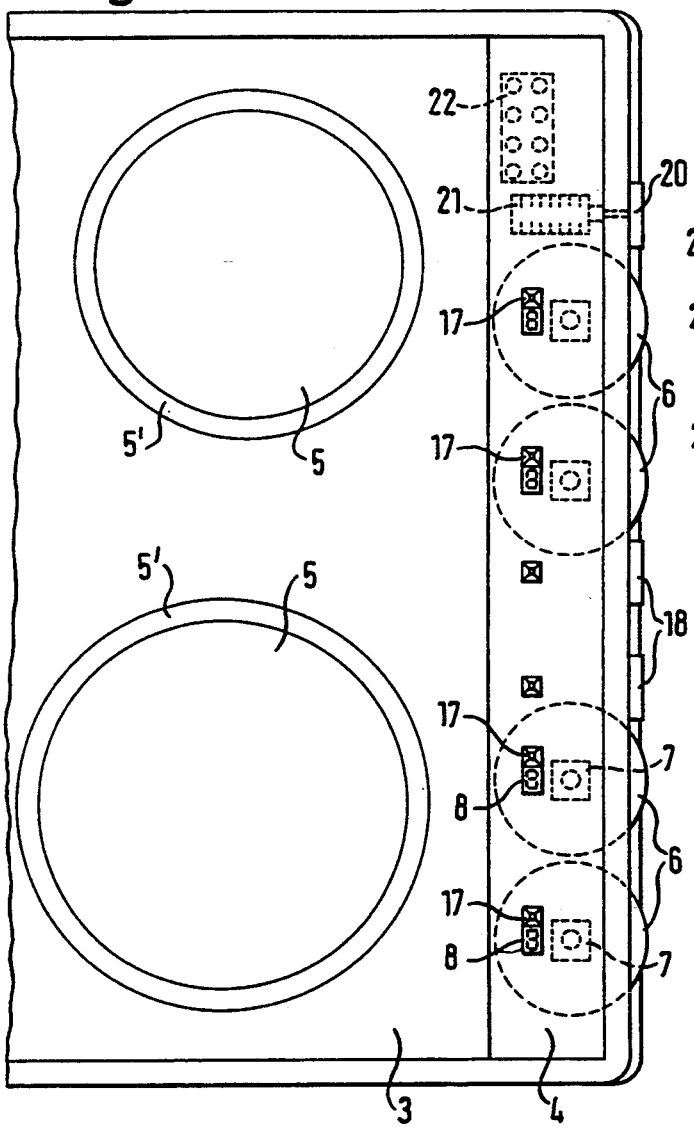
FIG. 3 is an enlarged, fragmentary, top-plan view of a somewhat different embodiment of part of the cooktop of FIG. 1.

In the exemplary embodiment of FIGS. 1, 2 and 3, both the cooking surface 3 and the control surface 4 are formed of glass ceramic material. In FIG. 2, the cooking surface 3 is formed of a substantially square glass ceramic plate 9, while the control surface 4 is formed by an elongated, narrow, glass ceramic plate 10 having the same surface structure and properties. Where they meet, the two plates 9 and 10 are immediately adjacent one another and are joined flexibly to one another through the use of a permanently-elastic adhesive material 11, such as silicon adhesive, in such a way that the two plates 9 and 10 abut one another virtually seamlessly. The two glass ceramic plates 9 and 10 thus form a structural unit, which is manufactured as a flat package and is kept in inventory and which when joined to the cooktop frame 1, is brought to the swiveled position of FIG. 2 in the manner of a film hinge. In order to retain this composite unit 9, 10, corresponding supports 12 are provided on the cooktop frame 1. The composite unit 9, 10 is placed on the supports 12 and sealed off at its periphery from the cooktop frame 1 with a suitable sealing material. At the level of the display devices 8, the glass ceramic plate 10 forming the control surface 4 has corresponding transparent regions or windows 13, through which the seven-segment display can be seen.

Figure 6:
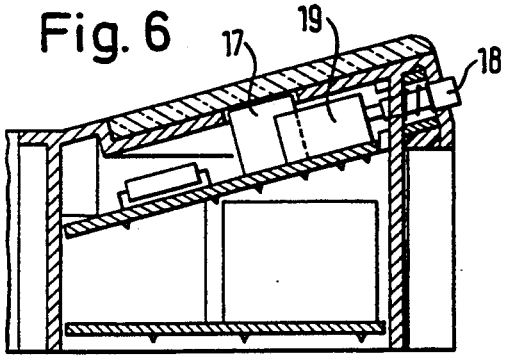
FIG. 6 is a longitudinal-sectional view of an operating device which is constructed as a pressure-type switch.
Figure 7:
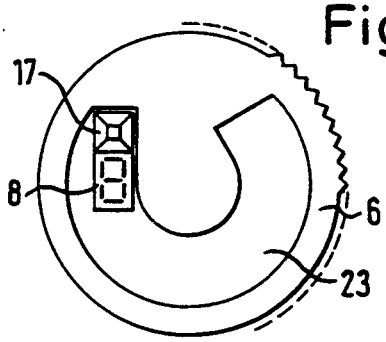
FIG. 7 is a top-plan view of a knurled disk, serving as an operating device for the cooktop of FIG. 3.
Figure 8:
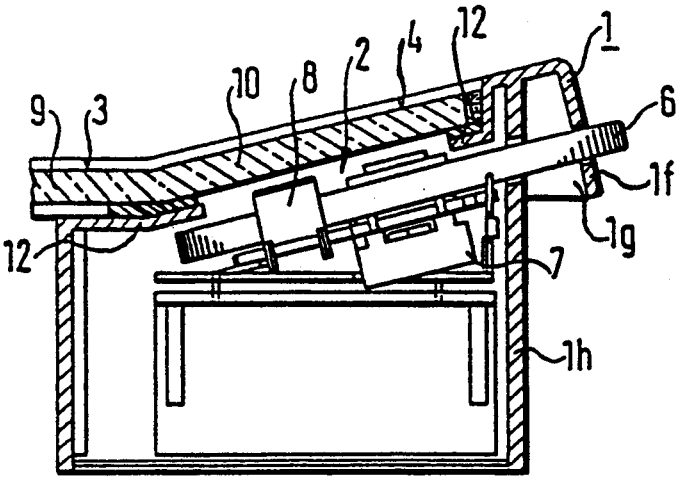
FIG. 8 is a view similar to FIG. 2 with a one-piece glass ceramic plate forming the cooking and control surfaces.

The embodiment of FIGS. 2 and 3 relates to an electronic version of the control devices 2. In this case, each knurled disk 6 is axially joined to a respective one of the aforementioned encoding switches 7, which serves to directly set the electrical output at the heating body of the particular cooking location 5 associated with it. Each encoding switch is electrically connected with a respective one of the likewise aforementioned seven-segment displays 8 and with a respective further indicator device, which is constructed as an LED and which lights up whenever the knurled disk 6 is in the highest output stage, in which the associated heating body is operated in a temporary startup phase. In FIG. 3, these additional indicator devices are identified by reference numeral 17. In addition to the operating device that is constructed as a knurled disk 6, the exemplary embodiment of FIG. 3 has other operating elements disposed on the leg surface 1*f*. Operating devices that are shown at reference numeral 18 and are constructed as pushbuttons, are shown in FIG. 3 and in further detail in FIG. 6. The pushbuttons 18 are connected to microswitches 19 following the pushbuttons 18 and to the associated indicator devices 17, which again are constructed as LEDs. Through the use of these operating devices 18, selected zones of the multizone cooking locations 5 can be turned on. For example, one of the selected zones is an outer, annular heating zone 5′ of FIG. 3 which can be turned on, while in normal operation, or in other words with actuation of the knurled disks 6, only inner zones of these cooking locations are heated. Reference numeral 20 indicates a further operating device, which may be constructed as a pushbutton or a rotary knob. This operating device 20 serves to actuate a main switch, which is generally identified at reference numeral 21, for turning the entire cooktop on and off. Finally, reference numeral 22 indicates a grid connection block for electrically connecting the cooktop to the power grid or mains. Therefore, the cooktop described herein can be operated as a fully autonomous unit. Although not shown in further detail in the drawings, this cooktop may be used in the cutout of a kitchen counter, for instance on top of a built-in or below-counter oven, in a known manner. Once the main switch 20 has been turned on, the desired heating outputs of the cooking locations 5 can be adjusted by rotating the knurled disks 6 and optionally by actuating the pushbuttons 18. Maximum intuitive simplicity is assured by the fact that the operating devices and indicator devices are in the immediate vicinity of one another. This simplicity is even still further increased by the fact that the control surface 4 is sloped upward at an angle relative to the horizontal cooking surface 3, as can be seen from FIG. 2, and only the indicator devices are disposed in the region of this control surface 4. Therefore, no breaks or openings need be provided in this control surface. While three quarters of the cooktop surface is formed of two glass ceramic plates 9 and 10 in the exemplary embodiment, it is naturally also possible for these surfaces to be formed of a one-piece continuous plate, for instance a glass ceramic plate, which is bent in the region of a bending point 15 shown in FIG. 1. FIG. 7 separately shows a knurled disk 6 which is provided for the electronic version of FIG. 3 and is provided with recesses 23 in the form of portions of rings. The indicator devices 8 and 17 are visible from above through these recess.

Figure 4:
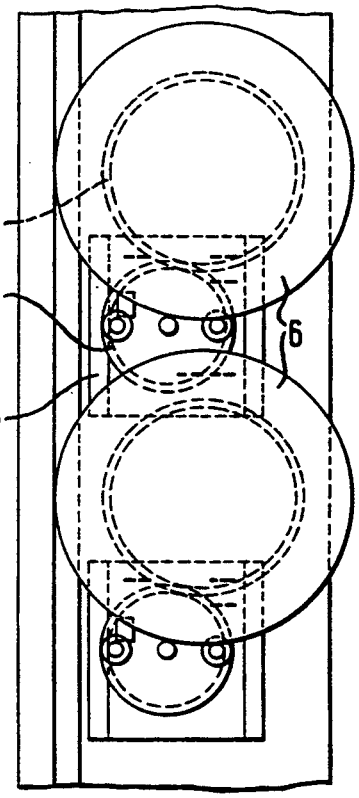
FIGS. 4 and 5 are respective fragmentary top-plan and longitudinal-sectional views of a different embodiment of operating and indicator elements.
Figure 5:
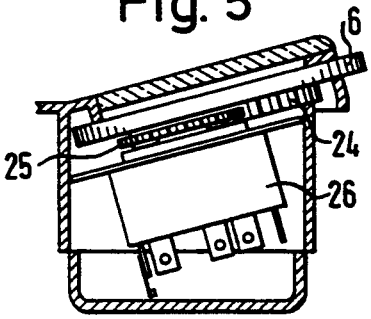

In the exemplary embodiment of FIGS. 4 and 5, the control devices are constructed electromechanically. Each knurled disk 6 is coupled in a geared fashion to an energy regulator 26 that is known per se, through a gear wheel transmission 24/25, so that a ratio between on time and off time of the heating body of the associated cooking location can be adjusted in a known manner by turning the knurled disk 6. In this electromechanical version, adjustment identifiers, such as numbers that indicate the rotary angle of the knurled disk 6 at a given time, are printed on the surface of the knurled disks and serve as indicator devices that are visible through the window provided in the control surface 4.

We claim:

1. A cooktop, comprising:

a substantially horizontal cooking surface having at least one cooking location;

a cooktop frame to be inserted into a kitchen work counter, said cooktop frame surrounding said cooking surface and having a frame leg protruding above said cooking surface, said frame leg having an outer leg surface extending downward in the inserted portion of the cooktop;

control devices for said cooking locations being disposed at least on said frame leg, said control devices including at least one operating device disposed on said outer leg surface of said frame leg; and a control surface associated with said frame leg and bordering said downward extending outer leg surface, said control surface serving as part of said cooking surface and being immediately adjacent to and rising at an angle upward relative to said cooking surface, and indicator devices being associated with said at least one operating device and being disposed on said control surface.

2. The cooktop according to claim 1, wherein said cooking surface has a plurality of said cooking locations.

3. The cooktop according to claim 1, wherein said control surface being is directly associated with said frame leg.

4. The cooktop according to claim 1, wherein said cooking surface and said control surface are formed of a one-piece glass ceramic plate.

5. The cooktop according to claim 1, wherein said cooking surface and said control surface are formed of separate glass ceramic plates having edges being adjacent one another and joined together by connecting means.

6. The cooktop according to claim 5, wherein said edges are joined together by said connecting means in an articulated manner.

7. The cooktop according to claim 1, including a front of said frame and a back of said frame, said frame leg with said control devices being a lateral frame leg extending between said front and back of said frame.

8. The cooktop of one according to claim 1, including indicator devices being disposed underneath said control surface, and transparent windows in said control surface for said indicator devices.

9. The cooktop according to claim 1, wherein said at least one operating device includes rotatable knurled disks having circular portions protruding slightly above said outer leg surface of said frame leg.

10. The cooktop according to claim 9, including electrical switches or regulators being individually associated with heating bodies for said cooking locations and being connected to said knurled disks.

11. The cooktop according to claim 9, including electronic switches or regulators being individually associated with heating bodies for said cooking locations and being connected to said knurled disks.

12. The cooktop according to claim 9, including associated indicator devices connected to said knurled disks.

13. The cooktop according to claim 1, wherein said at least one operating device on said outer leg surface of said frame leg is in the form of pushbuttons.

* * * * *